US006181330B1

(12) United States Patent
Yui et al.

(10) Patent No.: US 6,181,330 B1
(45) Date of Patent: Jan. 30, 2001

(54) WIDTH ADJUSTMENT CIRCUIT AND VIDEO IMAGE DISPLAY DEVICE EMPLOYING THEREOF

(75) Inventors: Hirokatsu Yui, Fujisawa; Hiromitsu Torii, Kamakura; Yoshikuni Shindo, Sapporo, all of (JP)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 08/998,445

(22) Filed: Dec. 26, 1997

(30) Foreign Application Priority Data

Dec. 27, 1996 (JP) ..... 8-357915

(51) Int. Cl.[7] ..... G09G 5/00
(52) U.S. Cl. ..... 345/204; 345/3; 345/132
(58) Field of Search ..... 345/132, 147, 345/153, 123, 204, 3

(56) References Cited

U.S. PATENT DOCUMENTS

| | | | | |
|---|---|---|---|---|
| 4,831,441 | | 5/1989 | Ando . | |
| 5,095,280 | | 3/1992 | Wunner et al. . | |
| 5,283,651 | | 2/1994 | Ishizuka . | |
| 5,473,382 | | 12/1995 | Nohmi et al. . | |
| 5,841,430 | * | 11/1998 | Kurikko | 345/213 |
| 5,874,937 | * | 2/1999 | Kesatoshi | 345/127 |
| 5,990,858 | * | 11/1999 | Ozolins | 345/99 |
| 5,995,162 | * | 11/1999 | Fujimori | 348/569 |

FOREIGN PATENT DOCUMENTS

| | | |
|---|---|---|
| 0609843 | 8/1994 | (EP) . |
| 0730372 | 9/1996 | (EP) . |
| 9-247574 | 9/1997 | (JP) . |
| 9-247588 | 9/1997 | (JP) . |
| WO98/10407 | 3/1998 | (WO) . |

OTHER PUBLICATIONS

Kasai et al: "26.4L: Late–News Paper: Development of 13.3–In. Super TFT–LCD Monitor", SID International Symposium. Digest of Technical Papers, San Diego, May 12, 1996, no. vol. 27, pp. 414–417, XP000621050.

European Search Report, dated Aug. 10, 1999, appln. no. 97122708.7–2205.

* cited by examiner

*Primary Examiner*—Steven J. Saras
*Assistant Examiner*—Tewolde Mengisteab
(74) *Attorney, Agent, or Firm*—Ratner & Prestia

(57) ABSTRACT

A video display device for displaying a wide range of video signals which allows the user to freely set the screen display width and position. A request for adjusting the horizontal display width, vertical display width, horizontal display position, and vertical display position is made through a key circuit, and a microcomputer determines the state of the key circuit. The microcomputer then recalculates the horizontal expansion rate and vertical expansion rate of a scan converter, and send recalculated data to the scan converter and a PLL circuit. The scan converter and the PLL circuit converts signals to the number of picture elements displayable on the video display device in response to a request for adjustment, and changes the phase of the enable signal which indicates a display period of the video display device to adjust horizontal and vertical display positions.

9 Claims, 3 Drawing Sheets

WIDTH ADJUSTMENT CIRCUIT AND VIDEO IMAGE DISPLAY DEVICE EMPLOYING THEREOF

FIELD OF THE INVENTION

The present invention relates to video display devices for sampling and displaying the video output signal from signal sources such as computers, and more specifically, to horizontal display width adjustment circuits and vertical display width adjustment circuits which allow the width of the display screen to be adjusted as required to overcome timing incompatibility between the input video signal and the predetermined effective screen area. The present invention is further related to a liquid crystal video display device employing these width adjusting circuits.

BACKGROUND OF THE INVENTION

The phase difference between the horizontal and vertical synchronizing signals and video signals produced from signal sources such as computers generally vary according to the signal source. The number of picture elements per horizontal scanning period and the number of lines per vertical scanning period of the video signal produced from the signal source also vary.

To enable the display of a wide variety of signals as mentioned above on a video display device, display elements for one picture element of the signal source are conventionally displayed having a picture element : display element ratio of 1 : 1 or 1: integer.

If the number of picture elements in the signal source is less than the number of display elements of the video display device and the picture elements are displayed in a one to one ratio, the display width of that signal source becomes smaller than the displayable screen area. Similarly, if the number of picture elements in the signal source is less than the number of display elements of a video display device and the picture elements are displayed in a one to integer ratio, the image width may become wider than the displayable screen area.

As described above, the prior art may display the video image of the signal source at a narrower width than the displayable screen area of the video display device depending on the video output signal from the computer when video output signals from different models of computer are displayed in a one to one ratio (the ratio of the number of picture elements in the signal source to the number of display elements).

In addition, the video image of the signal source may become wider than the displayable screen area of the video display device in the prior art, depending on the video output signal from the computer, when video output signals from different models of computers are displayed in a one to integer ratio (the ratio of the number of picture elements in the signal source to the number of display elements). As a result, the user may not be able to see part of the video image, and may need to adjust one or both of the horizontal and vertical screen positions to see the missing portion of the video image.

SUMMARY OF THE INVENTION

A display width adjusting circuit of the present invention comprises a key circuit for requesting expansion and compression of horizontal and vertical display areas, a microcomputer for detecting the on and off states of the key circuit and also detecting horizontal and vertical synchronizing signal frequency of the input video signal, a PLL circuit which receives the setting for the frequency division ratio from the microcomputer, an A/D converter which receives the analog video signal and is controlled by the PLL circuit under the control of the microcomputer, and a scan converter which receives the output signal from the A/D converter, horizontal and vertical synchronizing signals, and the clock signal from the PLL circuit, and is controlled by the microcomputer for outputting the video signal which can be displayed in a required size of display image on a required area of the screen of a video display device.

DETAILED DESCRIPTION OF THE INVENTION

First Exemplary Embodiment

Figure 1:
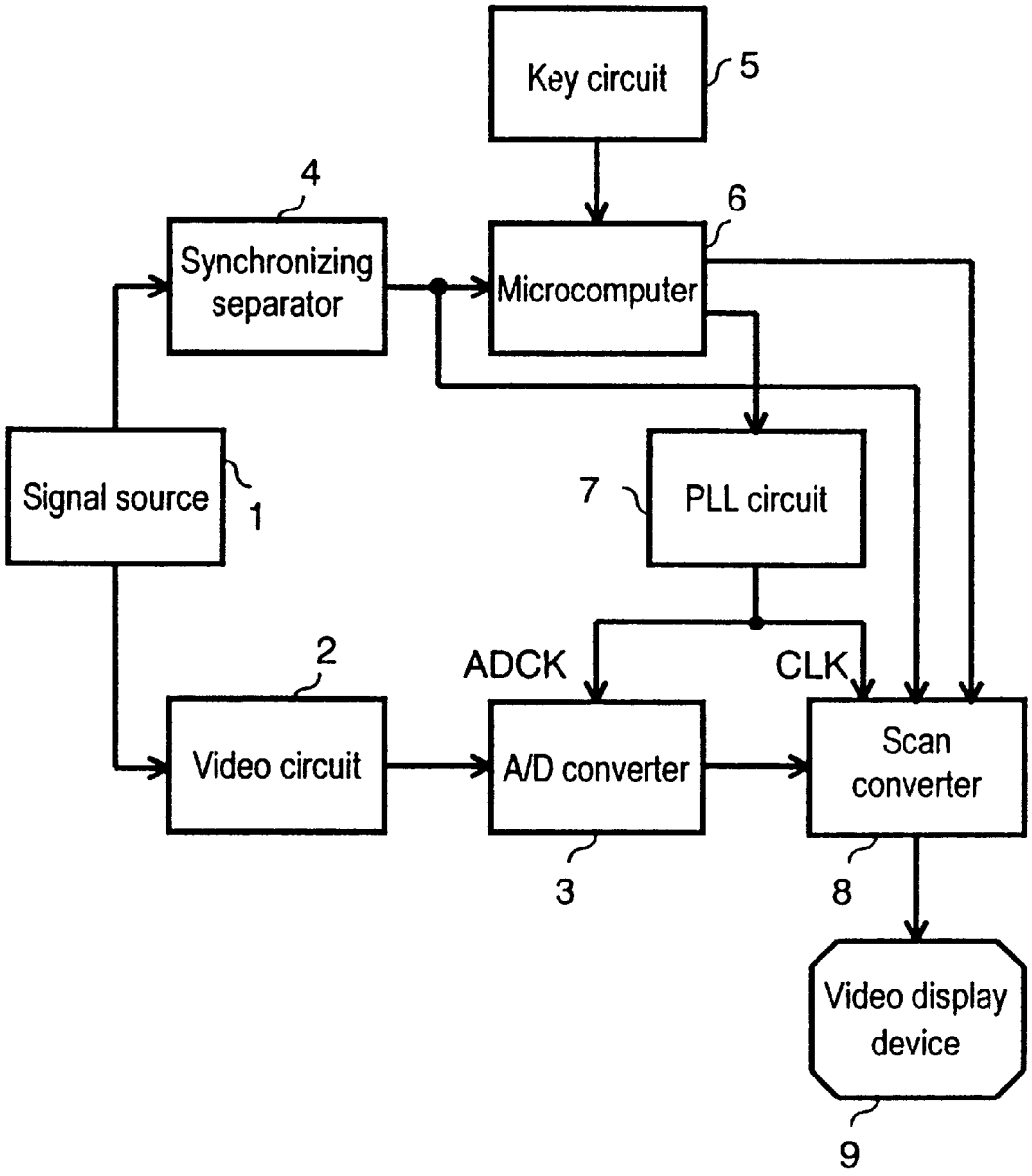
FIG. 1 is a block diagram of a horizontal display width adjusting circuit, vertical display width adjusting circuit, and a video display device employing the adjusting circuits in accordance with a first and second exemplary embodiments of the present invention.

In FIG. 1, a signal source 1 outputs analog R, G, and B signals and synchronizing signals. A video circuit 2 amplifies the analog R, G, and B signals output from the signal source 1, and outputs amplified analog R, G, and B signals. An A/D converter 3 samples the analog R, G, and B signals amplified by the video circuit 2 according to a sampling signal ADCK output from a PLL circuit 7, converts them to digital R, G, and B signals by quantization, and outputs the digital R, G, and B signals.

A synchronizing separator 4 separates and outputs the horizontal synchronizing signal and vertical synchronizing signal from the signal output from the signal source.

A key circuit 5 adjusts the video display width and sets the position of the display screen, luminance, and contrast of the video display device 9 by turning on and off a key switch. A detector (e.g. microcomputer) 6 detects the on and off states of the key switch.

The microcomputer 6 also calculates the frequency of the horizontal and vertical synchronizing signals output from the synchronizing separator 4.

The microcomputer 6 furthermore outputs a specified frequency division ratio to a PLL circuit 7 based on the calculated frequency of horizontal and vertical synchronizing signals, and outputs the control signal for adjusting the horizontal display width according to the detected on and off states of the key switch when the key switch requests adjustment of the horizontal width of the video image to be displayed.

The PLL circuit 7 produces and outputs the sampling signal ADCK to the A/D converter 3 and a clock signal CLK to a scan converter 8.

The scan converter 8 is driven by the clock signal CLK output from the PLL circuit 7. The scan converter 8 converts the horizontal and vertical synchronizing signals output from the synchronizing separator 4 and the digital R, G, and B signals output from the A/D converter 3 to the number of picture elements displayable on a video display device 9 based on the control signal from the microcomputer 6.

The scan converter 8 then produces the enable signal in response to the control signal from the microcomputer 6, using the clock signal CLK generated from the PLL circuit and the horizontal and vertical synchronizing signals output from the synchronizing separator 4.

The microcomputer 6 also changes the horizontal conversion rate of the scan converter 8 which sets the horizontal display width and the phase of the enable signal which indicates the display period of the video display device 9 if there is a request to change the display condition from the key circuit 5. This allows adjustment of the horizontal display width and shifting the horizontal display position sideways as desired.

Figure 2:
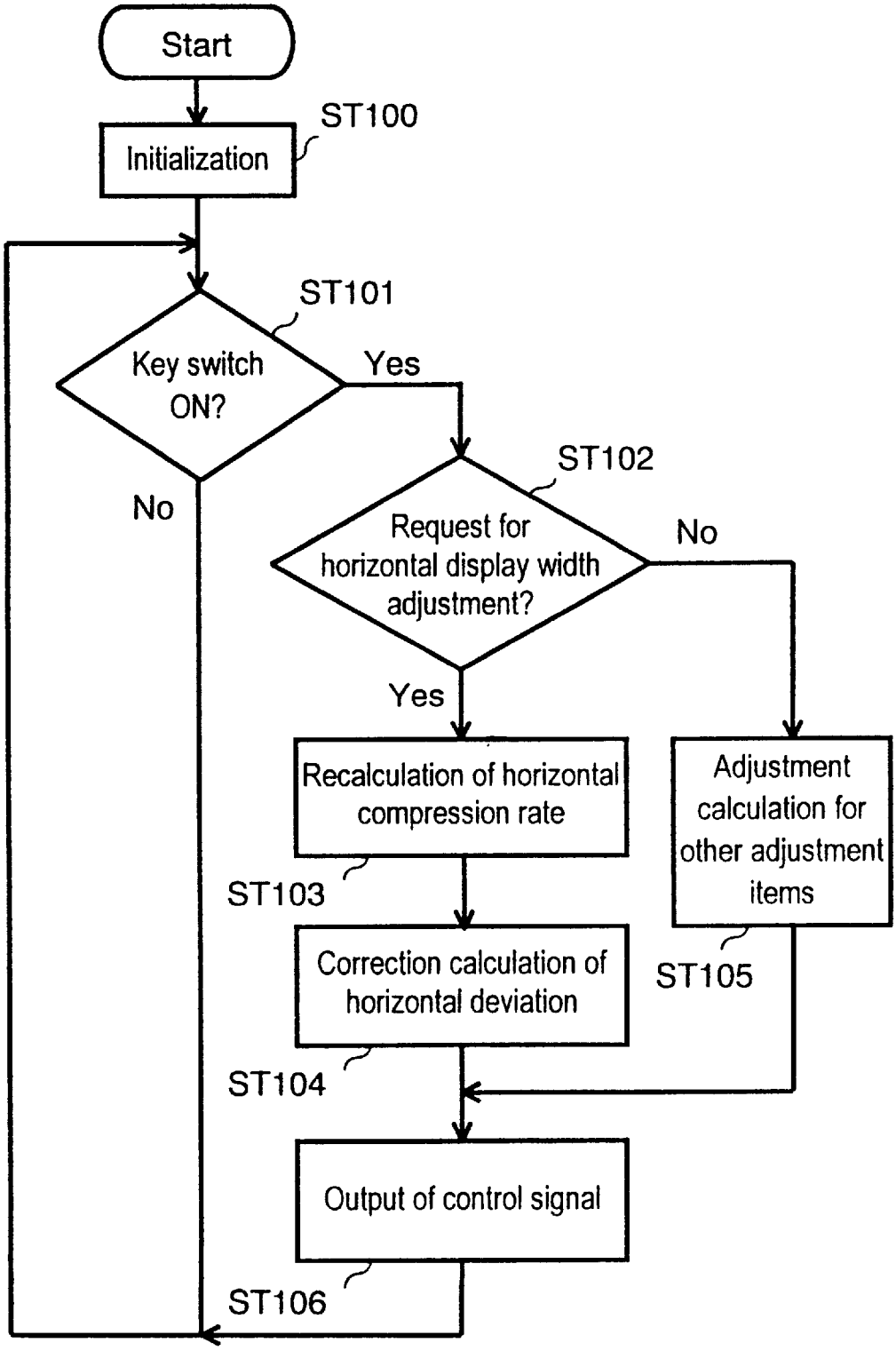
FIG. 2 is a control flow chart for the horizontal display width adjusting circuit in FIG. 1.

Next, the adjustment of the horizontal display width is explained with reference to FIG. 2 which is a control flow chart for the horizontal display width adjustment circuit.

(1) The microcomputer 6*a*) detects the frequency of the horizontal and vertical synchronizing signals output from the synchronizing separator 4 by counting synchronizing signal pulses over a certain period, b) processes the horizontal display width adjustment data based on the detected frequency, and c) sends the processed horizontal display width adjustment data to the PLL circuit 7 and the scan converter 8.

Alternatively, the microcomputer 6 conducts initialization by reading out the horizontal display width adjustment data stored in a memory in the microcomputer 6 and sending it to the PLL circuit 7 and the scan converter 8. (Step ST100)

(2) The microcomputer 6 checks the on and off states of the key switch in the key circuit 5 to identify whether the user has requested adjustment using the key. (Step ST101)

(3) If the microcomputer 6 determines that there has not been a request from the user for adjustment using the key input in Step ST101, the microcomputer 6 repeats Step S101.

If the microcomputer 6 determines that there has been a request from the user for adjustment using the key input in Step ST101, the microcomputer 6 checks whether the request for adjustment is for the horizontal display width. (Step ST102)

(4) If the microcomputer 6 determines that the request from the user is not for adjusting the horizontal display width in Step ST102, other adjustments (e.g. vertical display width) are executed. (Step ST105)

(5) If the microcomputer 6 determines that the request from the user is for the horizontal display width in the previous Step ST102, the next adjustment operation is executed. Specifically, if the request is to widen the horizontal display width in proportion to the horizontal display width initially set in Step ST100, the horizontal expansion rate is calculated in accordance with the requested expansion value. If the request is to narrow the horizontal display width , the horizontal compression rate is calculated in accordance with the requested compression value. (Step ST103)

(6) The microcomputer 6 calculates the degree of horizontal correction desired to correct the horizontal deviation on the screen of the video display device 9 which may have occurred as a result of Step ST103. (Step ST104)

(7) The microcomputer 6 converts data processed in Steps ST103, ST104, and ST105 into the control signal for controlling the PLL circuit 7 and the scan converter 8, and outputs the control signal. (Step ST106)

(8) The microcomputer 6 repeats the steps from ST1O1 to ST106 until the power to the microcomputer 6 is turned off.

Any request to adjust the horizontal display width can be checked at any time by repeating Steps ST101 to ST106, and the horizontal display width can be adjusted according to the new requested value.

In the above explanation, the microcomputer 6 counts the number of synchronizing signal pulses over a certain period to calculate the frequency of the horizontal and vertical synchronizing signals in Step ST100. It will be apparent that the microcomputer 6 can also count the time between a certain number of synchronizing signal pulses.

Second Exemplary Embodiment

A block diagram of a second exemplary embodiment is the same as the first exemplary embodiment as shown in FIG. 1, and therefore the explanation of the configuration is omitted. In the first exemplary embodiment, however,the microcomputer outputs the control signal for adjusting the horizontal display width. In the second exemplary embodiment, the microcomputer 6 outputs the control signal for adjusting the vertical display width.

The microcomputer 6 also changes the vertical conversion rate of the scan converter 8 which sets the horizontal display width and the phase of the enable signal which indicates the display period of the video display device 9 if there is a request to change the display condition from the key circuit 5. This allows adjustment of the vertical display width and shifting the display position up and down as desired.

Figure 3:
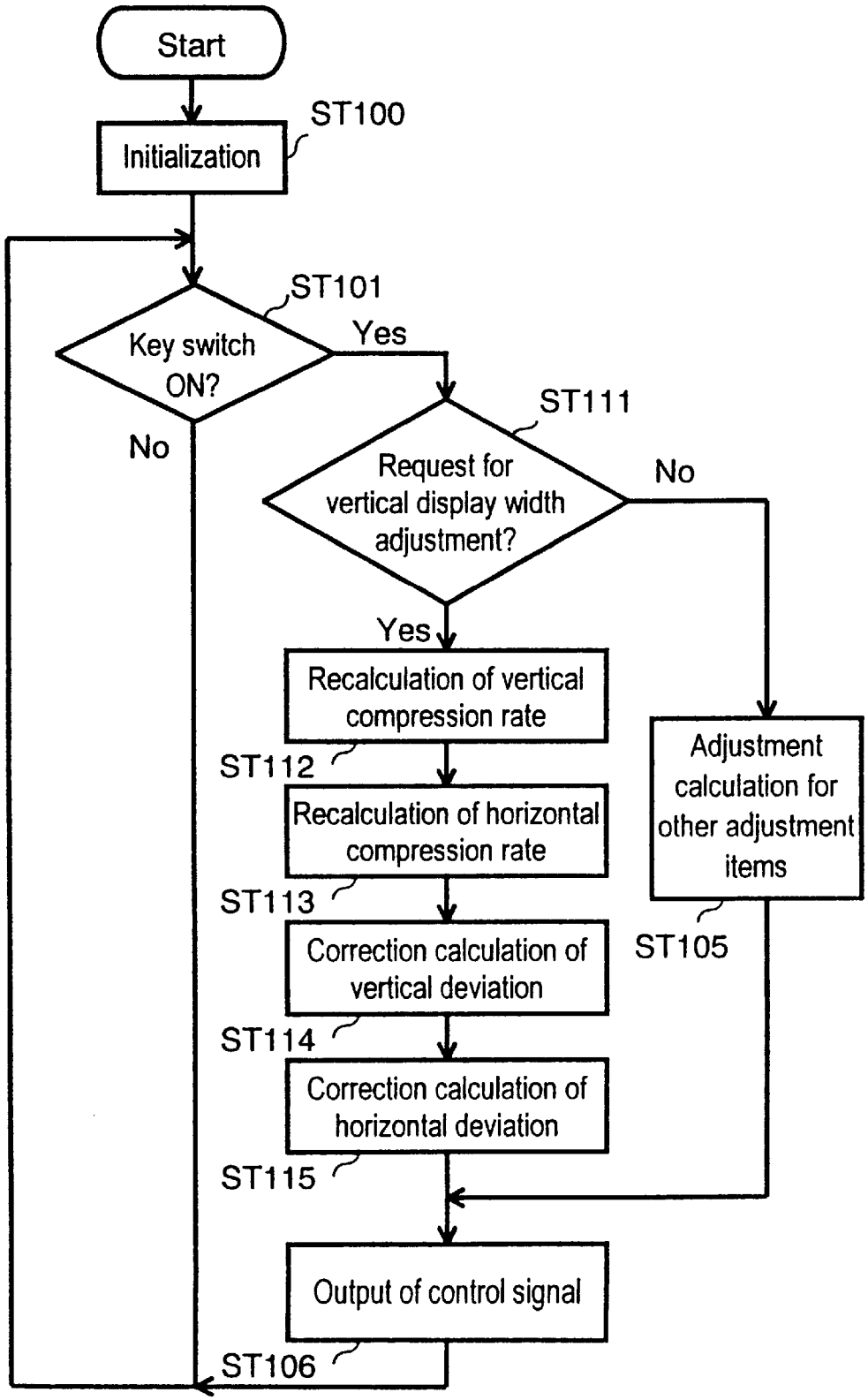
FIG. 3 is a control flow chart for the horizontal display width adjusting circuit in FIG. 1.

The control of the vertical display width adjustment circuit is explained with reference to FIG. 3 which is a control flow chart for the vertical display width adjustment circuit.

(1) The microcomputer 6*a*) detects the frequency of the horizontal and vertical synchronizing signals output from the synchronizing separator 4 by counting synchronizing signal pulses over a certain period, b) processes the vertical display width adjustment data based on the detected frequency, and c) sends the processed vertical display width adjustment data to the PLL circuit 7 and the scan converter 8.

Alternatively, the microcomputer 6 conducts initialization by reading out the vertical display width adjustment data stored in a memory in the microcomputer 6 and sending it to the PLL circuit 7 and the scan converter 8. (Step ST100)

(2) The microcomputer 6 checks the on and off states of the key switch in the key circuit 5 to identify whether the user has requested adjustment using the key. (Step ST101)

(3) If the microcomputer 6 determines that there has not been a request from the user for adjustment using the key input in Step ST101, the microcomputer 6 repeats Step ST101.

If the microcomputer 6 determines that there has been a request from the user for adjustment using the key input in the previous Step ST101, the microcomputer 6 checks whether the request for adjustment is for the vertical display width. (Step ST111)

(4) If the microcomputer 6 determines that the request from the user is not for adjusting the vertical display width in Step ST111, other adjustments (e.g. horizontal display width) are executed. (Step ST105)

(5) If the microcomputer 6 determines that the request from the user is for the vertical display width in Step ST111, the next adjustment operation is executed. Specifically, if the request is to widen the vertical display width in proportion to the vertical display width initially set in the previous Step ST100, the vertical expansion rate is calculated in accordance with the requested expansion value. If the request is to narrow the vertical display width, the vertical compression rate is calculated in accordance with the requested compression value. (Step ST112)

(6) By executing Step ST112, discrepancies occur with the horizontal and vertical synchronizing signals, clock signal, and video signal which are output from the scan converter 8 to the video display device 9.

In order to avoid the occurrence of a discrepancy between the vertical expansion rate calculated in Step ST112 and the horizontal and vertical synchronizing signals, clock signal, and video signal output from the scan converter 8 to the video display device 9, the microcomputer 6 recalculates the horizontal expansion rate for the number of horizontal picture elements in the video signal which the scan converter 8 outputs to the video display device 9. (Step ST113)

(7) The microcomputer 6 calculates the degree of vertical correction required to correct the vertical deviation on the screen of the video display device 9 which may have occurred as a result of Step ST112. (Step ST114)

(8) The microcomputer 6 calculates the degree of horizontal correction required to correct the horizontal deviation on the screen of the video display device 9 which may have occurred as a result of Step ST113. (Step ST115)

(9) The microcomputer 6 converts data processed in the previous Steps ST112, ST113, and ST114, ST115, and ST105 into the control signal for controlling the PLL circuit 7 and the scan converter 8, and outputs the control signal. (Step ST106)

(10) The microcomputer 6 repeats the steps from ST101 to ST115 until the power to the microcomputer 6 is turned off.

Any request to adjust the vertical display width can be checked at any time by repeating Steps ST101 to ST115, and the vertical display width can be adjusted according to the new requested value.

In the above explanation, the microcomputer 6 counts the number of synchronizing signal pulses over a certain period to calculate the frequency of the horizontal and vertical synchronizing signals in Step ST100. It will be apparent that the microcomputer 6 can also count the time between a certain number of synchronizing signal pulses to calculate the frequency of the synchronizing signals.

As explained above, a video display device employing the horizontal display width adjustment circuit and vertical display width adjustment circuit of the present invention enables the adjustment of horizontal and vertical display widths as desired. In other words, the present invention prevents the video output signal from a computer to be displayed in a narrower horizontal display area than that of the video display device, or contrarily, the video output signal from a computer to be displayed in a larger horizontal display area than that of the video display device which results in the user being unable to see the entire video image.

The present invention also selectively prevents the video output signal from a computer to be displayed in a narrower vertical display area than that of the video display device, or contrarily, the video output signal from a computer to be displayed in a larger display area than that of the video display device which results in the user being unable to see the entire video image.

The video display device of the present invention also has the advantage of selectively allowing the user to freely set the screen display width by incorporating the horizontal display width and vertical display width adjustment circuits.

The video display device of the present invention is not limited to liquid crystal video display devices. It can be applied to any display device employing discrete display elements in a matrix. For example, the present invention is also applicable to plasma video display devices. The exemplary embodiments described herein are therefore illustrative and not restrictive. The scope of the invention being indicated by the appended claims and all modifications which come within the true spirit of the claims are intended to be embraced therein.

What is claimed is:

1. A display width adjustment circuit for use with a video display and an input video signal having a horizontal synchronizing signal and a vertical synchronizing signal, said circuit comprising:

a key circuit for user control of at least one of an amount of expansion and an amount of compression of at least one of a horizontal display area and a vertical display area of the video display;

a detector for detecting i) a state of said key circuit and ii) a frequency of at least one of the horizontal and vertical synchronizing signals of the input video signal;

a PLL circuit which receives a frequency division ratio from said detector;

an A/D converter which receives the video signal and is controlled by an output of said PLL circuit; and a scan converter which receives i) an output signal from said A/D converter, and ii) at least one of the horizontal and vertical synchronizing signals, and outputs a converted video signal for displaying a corresponding video image on the video display.

2. A display width adjustment circuit as defined in claim 1, wherein a horizontal display width of the video image displayed on said video display is adjusted by said converter changing a horizontal conversion rate responsive to an output from said key circuit.

3. A display width adjustment circuit as defined in claim 1, wherein a horizontal display width of the video image displayed on said video display is adjusted by said A/D converter changing a horizontal sampling period responsive to an output from said key circuit.

4. A display width adjustment circuit as defined in claim 1, wherein a vertical display width of the video image displayed on said video display is adjusted by said scan converter changing a vertical conversion rate responsive to an output from said key circuit.

5. A display width adjustment circuit as defined in claim 1, wherein a vertical display width of the video image displayed on said video display is adjusted by changing the number of sampling of the digitized signal per horizontal scanning period and the number of lines of the digitized signal per vertical scanning period responsive to an output from said key circuit.

6. A display width adjustment circuit as defined in claim 1, wherein a horizontal display width is adjusted and a horizontal display position is changed by said microcomputer changing a horizontal conversion rate in the scan converter and ii) a phase of an enable signal indicating a display period of said video display.

7. A display width adjustment circuit as defined in claim 1, wherein a vertical display width is adjusted and a vertical display position is changed by said microcomputer changing i) a vertical conversion rate in the scan converter and ii) a phase of an enable signal indicating a display period of said video display.

8. A video display device including horizontal and vertical display width adjustment circuits, said video display device for use with a display screen and a video signal having horizontal and vertical synchronizing signals, said device comprising:

a key circuit for user adjustment of at least one of a horizontal display width, a vertical display width, and a display position on the display screen;

a detector for detecting i) a state of said key circuit and ii) a frequency of at least one of the horizontal and vertical synchronizing signals of the input video signal, said microcomputer adjusting at least one of a horizontal display position and a vertical display position responsive to an output from said key circuit;

a PLL circuit which receives a frequency division ratio control signal from said detector based on said frequency of said horizontal and vertical synchronizing signals;

an A/D converter which receives the video signal and a first control signal from said PLL circuit; and a scan converter which receives i) an output signal from said A/D converter, and ii) at least one of the horizontal and vertical synchronizing signal, and outputs a converted video signal for displaying a corresponding video image on the display screen.

9. A video display device as defined in claim 8, wherein said microcomputer adjusts said at least one of the horizontal display position and the vertical display position by changing a phase of an enable signal which indicates a display period of said video display device in response to the output from said key circuit.

* * * * *

UNITED STATES PATENT AND TRADEMARK OFFICE

CERTIFICATE OF CORRECTION

PATENT NO. : 6,181,330 B1
DATED : January 30, 2001
INVENTOR(S) : Yui et al.

It is certified that error appears in the above-identified patent and that said Letters Patent is hereby corrected as shown below:

Title page,
Item [56], References Cited, OTHER PUBLICATIONS, insert:

-- Search Report corresponding to application no. EP 97 30 1375 dated January 6, 1998. --

-- "Application of the Digital Signal Operation", Society of Electronic Communication, May 20, 1981 (with partial English translation). --

Item [57], ABSTRACT,
Line 2, delete "which".
Line 2, delete "freely".
Line 12, delete "a" and insert -- the adjustment --.
Lines 12-13, delete "for adjustment".
Line 15, after "adjust" insert -- the --.

Column 6,
Line 34, "converter" insert -- scan --.

Signed and Sealed this

Seventeenth Day of December, 2002

JAMES E. ROGAN
*Director of the United States Patent and Trademark Office*